US008282317B2

(12) United States Patent
de Kerdanet

(10) Patent No.: US 8,282,317 B2
(45) Date of Patent: Oct. 9, 2012

(54) SUBSEA STRUCTURE AND METHODS OF CONSTRUCTION AND INSTALLATION THEREOF

(75) Inventor: Tegwen Bertrand Marie Miorcec de Kerdanet, Paris (FR)

(73) Assignee: Acergy France S.A., Suresnes (FR)

( * ) Notice: Subject to any disclaimer, the term of this patent is extended or adjusted under 35 U.S.C. 154(b) by 1618 days.

(21) Appl. No.: 10/535,792

(22) PCT Filed: Nov. 25, 2003

(86) PCT No.: PCT/EP03/14833

§ 371 (c)(1),
(2), (4) Date: May 23, 2005

(87) PCT Pub. No.: WO2004/051051

PCT Pub. Date: Jun. 17, 2004

(65) Prior Publication Data

US 2006/0002767 A1 Jan. 5, 2006

(30) Foreign Application Priority Data

Nov. 29, 2002 (GB) ..... 0227851.3

(51) Int. Cl.
*F16L 1/12* (2006.01)

(52) U.S. Cl. ..... 405/224.2; 405/218

(58) Field of Classification Search ..... 405/224.2
See application file for complete search history.

(56) References Cited

U.S. PATENT DOCUMENTS

| | | | | |
|---|---|---|---|---|
| 4,906,137 | A | 3/1990 | Maloberti | |
| 5,150,987 | A | 9/1992 | White | |
| 5,615,977 | A | 4/1997 | Moses | |
| 5,944,448 | A | 8/1999 | Williams | |
| 6,200,180 | B1 | 3/2001 | Hooper | |
| 6,244,347 | B1 | 6/2001 | Watkins | |
| 6,276,456 | B1 * | 8/2001 | Head | 405/168.1 |
| 6,364,022 | B1 | 4/2002 | Kodaissi | |
| 2002/0074135 | A1 | 6/2002 | Headworth | |
| 2002/0115365 | A1 | 8/2002 | Nish | |
| 2003/0026663 | A1 * | 2/2003 | Guesnon et al. | 405/224.2 |

FOREIGN PATENT DOCUMENTS

| | | |
|---|---|---|
| GB | 2309576 | 7/1997 |
| GB | 2336143 | 10/1999 |
| WO | WO 98/21415 | 5/1998 |
| WO | WO 99/41142 | 8/1999 |

OTHER PUBLICATIONS

Hybrid Riser Tower: from Functional Specification to Cost per Unit Length, J.F. Saint-Marcoux (Paragon), M. Rochereau (Stolt Offshore), DOT XIII Rio de Janeiro—Oct. 18, 2001—14 pages.

* cited by examiner

*Primary Examiner* — Tara Mayo-Pinnock

(74) *Attorney, Agent, or Firm* — Levy & Grandinetti

(57) ABSTRACT

A method and apparatus for buoyancy distribution along a substantially vertical submarine structure (100), the structure being provided with multiple modules (110), slidably mounted to the structure such that when vertically deployed at sea the modules are may adjust their positions along the structure by sliding, the force of each module acting upon the module above it rather than locally along the structure, resulting in the cumulative force (460) from the modules acting substantially against the top of the structure. Forces between modules may be evenly distributed by use of compliant intermediaries (310).

18 Claims, 4 Drawing Sheets

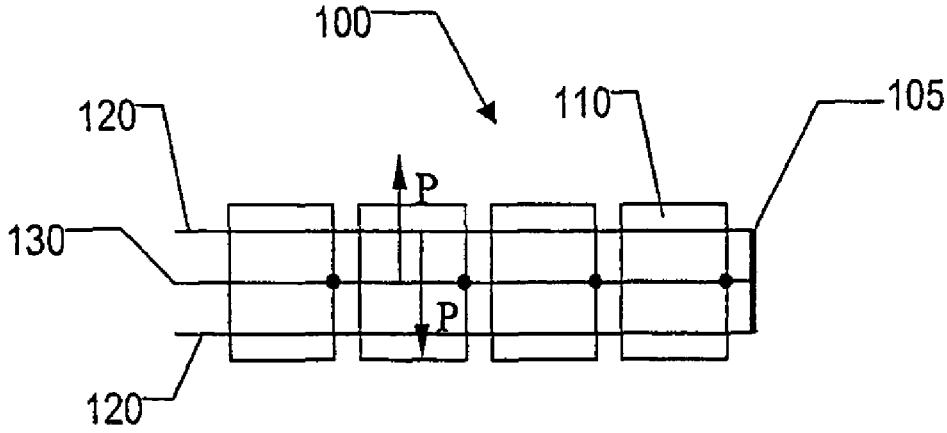
FIG. 1 – PRIOR ART
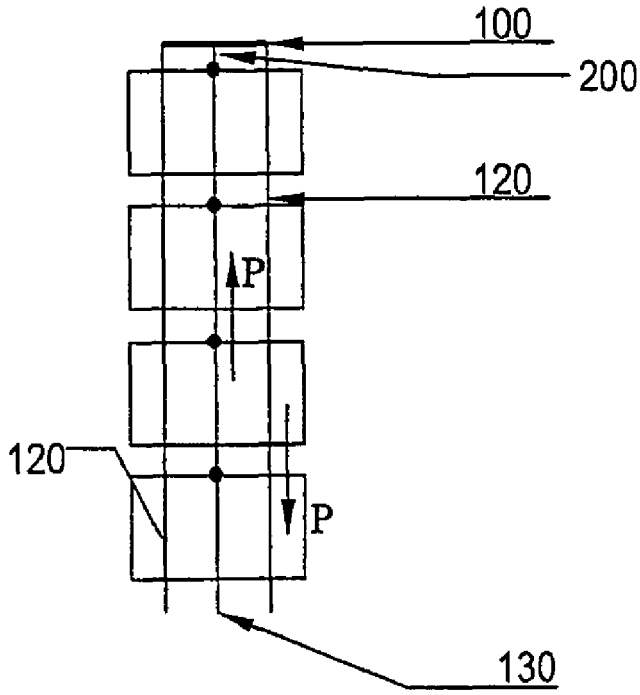
FIG. 2 – PRIOR ART

SUBSEA STRUCTURE AND METHODS OF CONSTRUCTION AND INSTALLATION THEREOF

BACKGROUND OF THE INVENTION

1. Field of the Invention

The present invention relates to method and apparatus for buoyancy distribution of offshore deepwater structures, in particular, but not restricted to, buoyancy distribution along a substantially vertical submarine structure, such as a riser, a bundle of risers, or any other structural member.

2. Description of the Prior Art

The structure may form part of a so-called hybrid riser, having an upper and/or lower portions ("jumpers") made of flexible conduit. U.S. Pat. No. 6,082,391 (Stolt/Doris) proposes a particular Hybrid Riser Tower consisting of an empty central core, supporting a bundle of riser pipes, some used for oil production some used for water and gas injection. This type of tower has been developed and deployed for example in the Girassol field off Angola. Insulating material in the form of syntactic foam blocks surrounds the core and the pipes and separates the hot and cold fluid conduits. Further background has been published in paper "Hybrid Riser Tower: from Functional Specification to Cost per Unit Length" by J-F Saint-Marcoux and M Rochereau, DOT XIII Rio de Janeiro, Oct. 18, 2001. Updated versions of such risers have been proposed in WO 02/053869 A1. The contents of all these documents are incorporated herein by reference, as background to the present disclosure.

Buoyancy of offshore structures is achieved by using temporarily or permanently attached buoyancy modules providing an upward thrust when submerged in the sea. Conventional devices such as stop-collars and clamps are used to transmit the buoyancy thrust from the buoyancy modules to the supported structure. The buoyancy thrust acts upon the structure where it is generated. The buoyancy modules are clamped around stop collars using straps or bolts.

In particular cases, such as a hybrid riser tower (bundle of risers, fabricated onshore), buoyancy may be required for the supporting of a structure in two (or more) completely different orientations, such as a horizontal orientation (during installation) and a vertical orientation (in operation).

The buoyancy thrust has to be transmitted in both orientations along two perpendicular directions, depending upon the orientation of the structure at the time. Having the buoyancy acting onto the structure where it is generated may be advantageous in one direction (supporting of horizontal risers during fabrication and installation), but a hindrance in another direction. Where two or more risers are bundled together it can be difficult to clamp buoyancy modules along each riser (due to differential thermal expansion, for example), or along one riser only (due to effective compression). To overcome this difficulty the modules are clamped to just one of the risers. However, in operation if the risers are hanging freely from the top structure of the bundle, the forces associated with weight compensation may induce a large compressive load on the riser to which the buoyancy modules are attached.

It is therefore an object of the invention to provide method and apparatus to transfer the substantial compressive forces provided by the buoyancy modules directly to the subsea structure, once installed, rather than via one or more of the risers.

SUMMARY OF THE INVENTION

In a first aspect of the invention there is provided a method of installing an elongate subsea structure, wherein said subsea structure is provided with a plurality of buoyancy modules, said buoyancy modules being slidably mounted to said subsea structure, such that when said subsea structure is deployed at sea in a substantially vertical orientation said buoyancy modules are free to adjust their positions up or down said subsea structure by sliding, the buoyancy force of each buoyancy module acting upon the buoyancy module above it rather than locally along the structure, and the cumulative buoyancy force from said buoyancy modules acting substantially against the top of said subsea structure.

This method allows all of the suspended weight of the subsea structure to be taken from its top, where all of the buoyancy force is applied. As a result, no single part of the structure, such as a riser, has to support the majority of the structure's weight.

For the above, substantially vertically can be taken to be some degree off true vertical, but orientated such that said elongate object rises substantially from seabed to surface. Also substantially acting from the top can be taken to mean acting some metres below the top, but such that the buoyancy is acting near the top taking into consideration the full length of the elongate object.

Said subsea structure will usually be a riser, such as a steel catenary riser, or a bundle of risers. Said bundle of risers may be a bundle of seven risers arranged with one in the centre and the rest spaced apart and distributed evenly around this. Instead of a riser, the central one may be a supporting core. In such a case, the transfer of the buoyant forces to the top of the structure is performed by the buoyancy modules, rather than by one core or core riser conduit. The excessive compressive loads otherwise imposed on that core conduit are thus avoided.

Each of said buoyancy modules may come in a number of sections, such that it can be fitted around all of the risers in a bundle of risers, as illustrated in WO '869, mentioned above.

Said buoyancy force may act from the top as a result of each buoyancy module acting on the one above, either directly or via an intermediary, the uppermost buoyancy module acting against a top plate. Alternatively the uppermost module could be fixed to said subsea structure. The intermediary may be a pad of compressible material.

Said buoyancy modules may, in their original configuration, be spaced substantially evenly along said subsea structure to enable said subsea structure to be floated to the deployment site in a substantially horizontal orientation prior to deployment.

The structure may be provided with a substantial top buoyancy. Alternatively, and in accordance with the invention of a further patent application having the same priority date as the present application, the structure may be supported completely by distributed buoyancy. The content of that other application is incorporated herein by reference (GB 0227850.5 agent's ref 64314 GB, published as WO2004051052.

In further aspects of the invention there are provided a structure prepared for installation by the method as described above, and a structure installed according to the method.

BRIEF DESCRIPTION OF THE DRAWINGS

Embodiments of the invention will now be described, by way of example only, by reference to the accompanying drawings, in which:

FIG. 1 is a schematic side-view of a known type of hybrid riser tower positioned horizontally during fabrication and installation, where the forces associated with weight/buoyancy compensation are distributed locally, throughout the whole of the structure;

FIG. 2 is a side view of the tower of FIG. 1, positioned vertically after installation, or during operation;

DETAILED DESCRIPTION OF THE EMBODIMENTS

Figure 3:
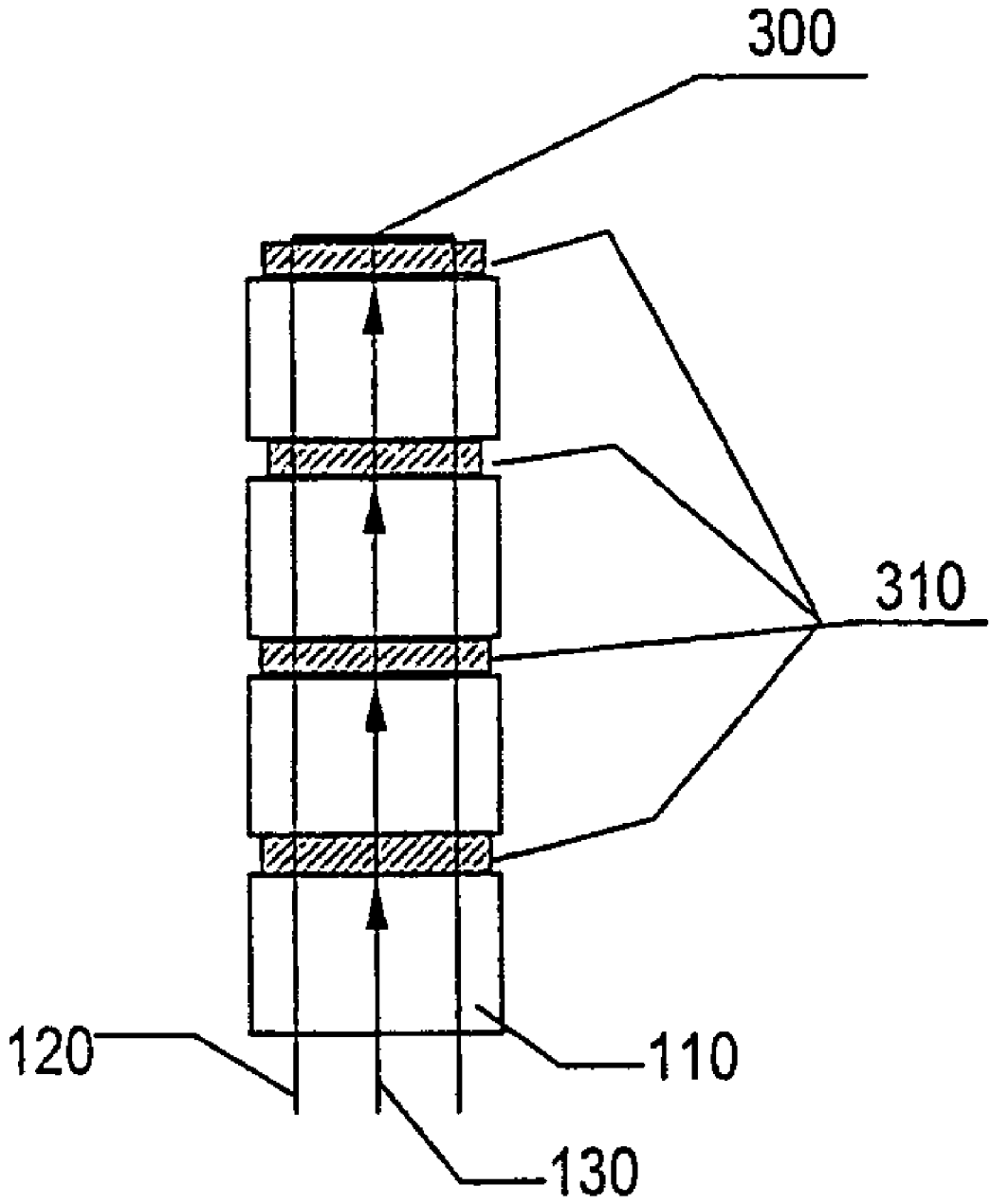
FIG. 3 is a side view of a tower modified in accordance with the invention, where the compensation forces are transmitted to the top of the structure via inter-buoyancy-module devices, rather than via the risers.

FIG. 1 shows a conventional method for providing buoyancy to a structure 100, by attaching buoyancy modules 110 to the riser(s) 120, 130 at regularly spaced points. During construction, or installation, and where the structure lies flat on the ocean, the forces P induced by the buoyancy modules are well distributed. It is impractical to clamp the buoyancy modules onto all of the risers due to the effects of differential thermal expansion, therefore they are only attached at single points X and usually to one of the risers, or support core.

FIG. 2 shows the structure of FIG. 1 in a vertical orientation. When submerged and upended, the risers hang freely from the top structure 105 of the bundle. The induced thrust provided by the weight compensation induces a large compressive load along the length of the riser 130 onto which the buoyancy modules are attached. The compression forces are at their greatest where the core riser 130 attaches 120 to the top of the structure, as the core riser 130 at that point has to balance the weights of the risers and their contents and the thrust of the buoyancy modules below.

FIG. 3 shows an improved method for providing buoyancy to a structure 100. All of the buoyancy forces P are transmitted onto the top of the structure without any force being transmitted via the riser(s) 120, 130. The buoyancy modules 110 are allowed to slide along the structure and transmit by themselves the cumulative up-lift force. Compliant inter-module devices 310 are used as an interface between the buoyancy modules to ensure that the up-lift forces are evenly transmitted between adjacent modules. Doing so maximises the contact surface area, thereby minimising stress points caused by surface irregularities, or where the structure is slightly bent.

Figure 4:
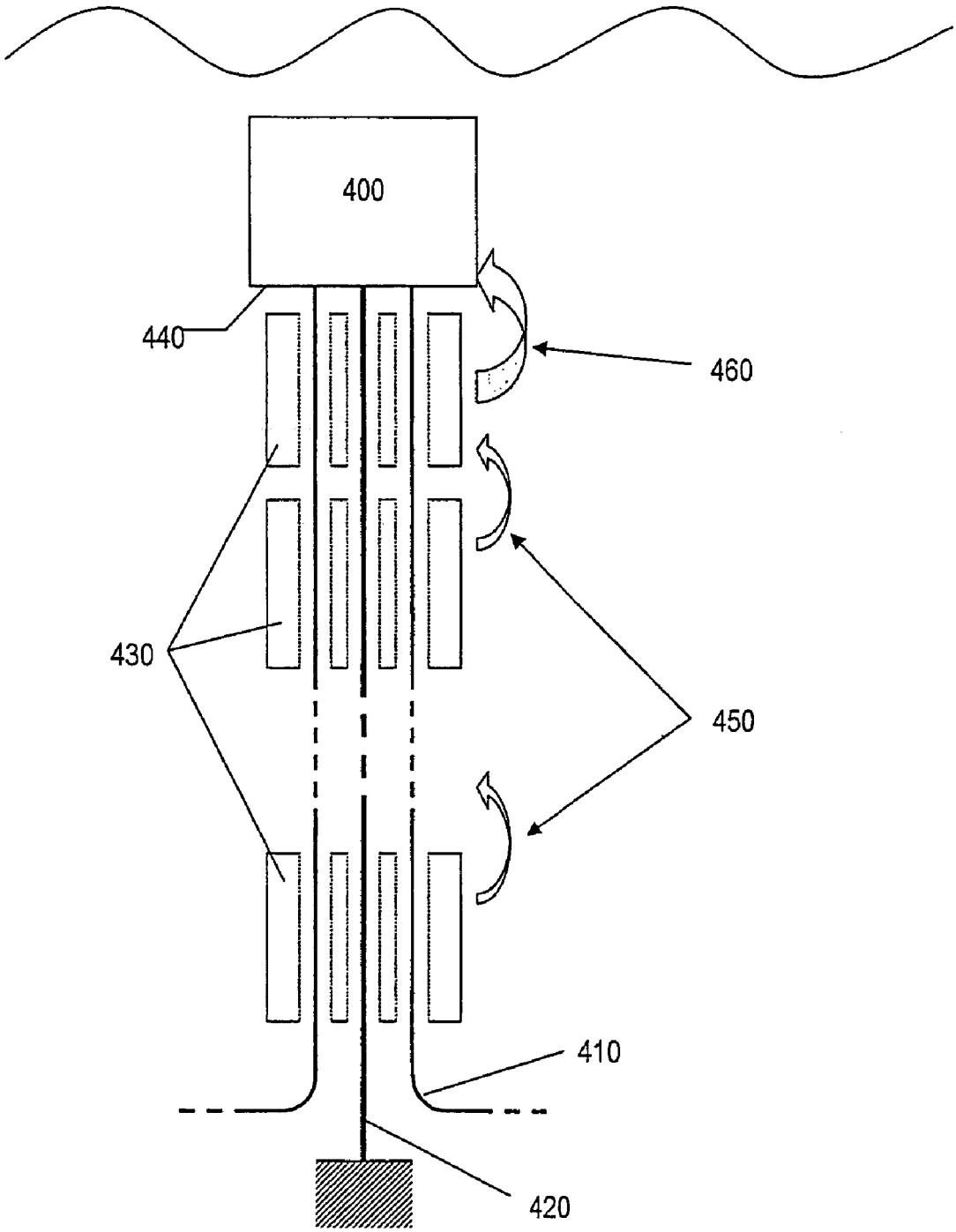
FIG. 4 is a more detailed side view of the improved method of buoyancy distribution showing combined buoyancy modules, risers and anchored core pipe.

FIG. 4 shows a first embodiment of a riser tower 400 having a vertical set of pipes (riser(s) 410 and/or structural members 420), which has been fabricated onshore, towed to the site, upended and set operational in a near-vertical configuration. Buoyancy is required during installation (towing and upending) perpendicularly to the tower axis and once installed, co-linearly to the tower axis. To avoid damage to the structure in the horizontal configuration, the buoyancy modules 430 have to be evenly distributed along the structure.

In the upended configuration, the up-thrust is transmitted to the top plate 440 forming part of the riser top structure 400 to compensate for the weight of the risers. The up-thrust is transmitted through surface contact between vertically adjacent buoyancy modules, as indicated by arrows, 450, with optional compliant devices between modules, not shown in FIG. 4. Transmission of the total thrust 460 to top plate 440 of the tower structure is via the uppermost buoyancy module.

The cross-sectional area of the buoyancy modules is such that the resulting stress in the uppermost module can be sustained, whereas if the up-thrust was transmitted via one of the pipes/risers then it would lead to unsustainable compressive loads.

As mentioned in the introduction, the top structure 400 may comprise a substantial buoy, as in the prior examples. Export of hydrocarbons is via flexible jumper hoses (not shown), one for each riser conduit.

Figure 5:
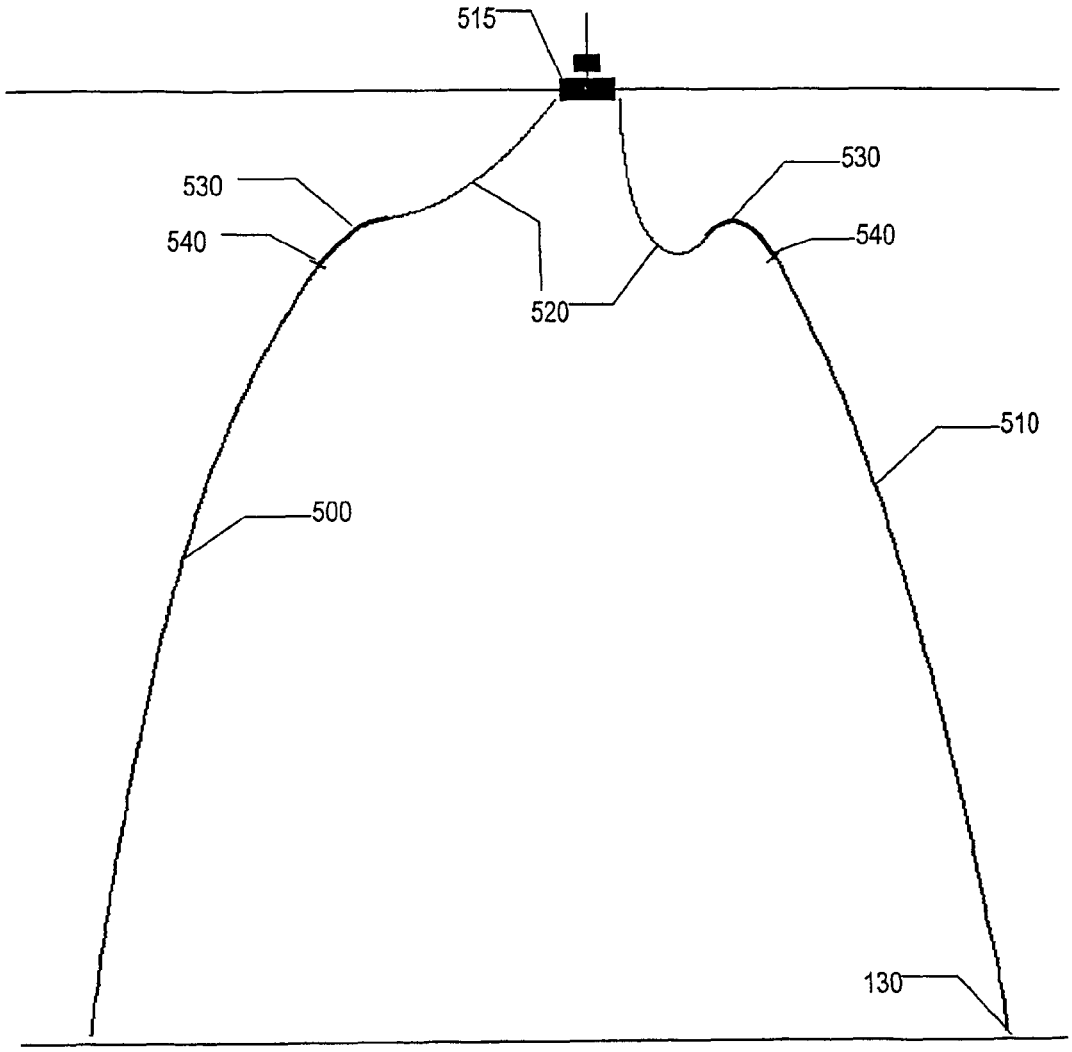
FIG. 5 is a side view of an alternative embodiment where riser towers are supported without using a top buoy.

Alternatively, the structure may rely entirely on distributed buoyancy, as described in our co-pending patent application (Agent's reference 64314GB). FIG. 5 shows an example of this alternative structure, whereby two riser bundles, or individual risers, 500, 510 connect to a floating vessel (FPSO) 515. Any additional top buoyancy has been replaced with distributed buoyancy. The figure shows the surface vessel subject to a positioning excursion (caused by the sea-state, for example). The left-hand riser is under greater tension than the right hand riser, but use of flexible top sections 520 allows the risers to accommodate the transitions.

Buoyancy for the risers is provided by the buoyancy already distributed along them for installation purposes, evenly distributing the complement required in operational conditions. It may be desirable to compensate for any surplus of buoyancy, during installation, by filling the structure with fluids heavier than those that will fill the conduits in operation. This will assist the process of sinking the lower part of the riser to the anchor point.

A consequence of the absence of a top buoy is that the structure supported in such a manner cannot withstand a large bending moment at top, since the only counteracting stiffness is given by the steel and is therefore very low, due to the slenderness of the structure. Using flexible sections 520 to connect to the top of the structure overcomes this problem, and providing them with a steep-wave shape, in order to apply tension co-linear with the structure, avoids a large bending, or rotational, moment. Each flexible section 520, at least in the region 530 above the junction 540 with the rigid portion 500/510, is also provided with distributed buoyancy for this purpose. The tension given by the flexibles, during operation, is taken into account when determining the buoyancy required along the structure itself.

In either type of installation, the installation process is broadly the same as that illustrated in U.S. Pat. No. 6,082,391, mentioned above. The height of the installed structure may for example be 500 m, or over 1 km.

The skilled person will further appreciate that the exact form of components and methods used can vary from the ones described herein without departing from the spirit and scope of invention.

The invention claimed is:

1. A method of installing an elongate subsea structure having a top, wherein said subsea structure is provided with a plurality of buoyancy modules, said buoyancy modules being slidably mounted to said subsea structure, such that when said subsea structure is deployed at sea in a substantially vertical orientation said buoyancy modules are free to adjust their positions up or down said subsea structure by sliding, the buoyancy force of each buoyancy module acting upon the buoyancy module above it rather than locally along the structure, and the cumulative buoyancy force from said buoyancy modules acting substantially against said top of said subsea structure.

2. A method of installing an elongate subsea structure as claimed in claim 1, wherein said substantially vertical orientation comprises some degree off true vertical, but orientated such that said elongate object rises substantially from seabed to surface.

3. A method of installing an elongate subsea structure as claimed in claim 1 or 2, wherein said acting substantially against the top comprises acting at a distance below the top, but such that the buoyancy is acting near the top taking into consideration the full length of the elongate object.

4. A method of installing an elongate subsea structure as claimed in any one of claim 1 or 2, wherein said subsea structure is a steel catenary riser.

5. A method of installing an elongate subsea structure as claimed in any one of claim 1 or 2, wherein said subsea structure comprises a bundle of risers.

6. A method of installing an elongate subsea structure as claimed in claim 5, wherein said bundle of risers comprises a bundle of seven risers arranged with one in the centre and the rest spaced apart and distributed evenly therearound.

7. A method of installing an elongate subsea structure as claimed in claim 6, wherein said central riser comprises a supporting core.

8. A method of installing an elongate subsea structure as claimed in claim 5, wherein said buoyancy modules are provided in a number of sections, to facilitate fitting around at least one of said risers.

9. A method of installing an elongate subsea structure as claimed in any one of claim 1 or 2, wherein said buoyancy force acts cumulatively as a result of each buoyancy module acting directly on the one above.

10. A method of installing an elongate subsea structure as claimed any one of claim 1 or 2, wherein said buoyancy force acts cumulatively as a result of each buoyancy module acting on the one above via an intermediary.

11. A method of installing an elongate subsea structure as claimed in claim 10, wherein said intermediary comprises a pad of compressible material.

12. A method of installing an elongate subsea structure as claimed in any one of claim 1 or 2, wherein said structure further comprises a top plate, said buoyancy force acting against the top of said structure as a result of the uppermost buoyancy module acting against said top plate.

13. A method of installing an elongate subsea structure as claimed in any one of claim 1 or 2, wherein said buoyancy force acts against the top of said structure as a result of the uppermost module being fixed to said subsea structure.

14. A method of installing an elongate subsea structure as claimed in any one of claim 1 or 2, wherein said buoyancy modules are, in their original configuration, spaced substantially evenly along said subsea structure to enable said subsea structure to be floated to a deployment site in a substantially horizontal orientation prior to deployment.

15. A method of installing an elongate subsea structure as claimed in any one of claim 1 or 2, wherein said structure is provided with a substantial top buoyancy.

16. A method of installing an elongate subsea structure as claimed in any one of claim 1 or 2, wherein the structure is supported completely by distributed buoyancy.

17. An elongate subsea structure prepared for installation by the method as claimed in any one of claim 1 or 2.

18. An elongate subsea structure installed by the method as claimed in any one of claim 1 or 2.

* * * * *